US008839491B2

(12) United States Patent
Kim

(10) Patent No.: US 8,839,491 B2
(45) Date of Patent: Sep. 23, 2014

(54) HANDLE ASSEMBLY FOR AN AIRTIGHT CONTAINER

(76) Inventor: Yong Jin Kim, Seoul (KR)

( * ) Notice: Subject to any disclaimer, the term of this patent is extended or adjusted under 35 U.S.C. 154(b) by 0 days.

(21) Appl. No.: 13/980,420

(22) PCT Filed: Dec. 15, 2011

(86) PCT No.: PCT/KR2011/009651

§ 371 (c)(1),
(2), (4) Date: Aug. 15, 2013

(87) PCT Pub. No.: WO2012/099335

PCT Pub. Date: Jul. 26, 2012

(65) Prior Publication Data

US 2013/0312218 A1 Nov. 28, 2013

(30) Foreign Application Priority Data

Jan. 21, 2011 (KR) ..... 10-2011-0006149

(51) Int. Cl.
*A47J 45/07* (2006.01)
*B65D 45/20* (2006.01)
*B65D 25/28* (2006.01)

(52) U.S. Cl.
CPC .. *B65D 25/2852* (2013.01); *B65D 2543/00194* (2013.01); *B65D 45/20* (2013.01); *B65D 2543/0087* (2013.01); *B65D 2543/00296* (2013.01); *B65D 2543/00231* (2013.01)
USPC ..... 16/425; 16/110.1

(58) Field of Classification Search
USPC ..... 16/110.1, 424, 425, 436, 439; 190/39, 190/115, 117
See application file for complete search history.

(56) References Cited

U.S. PATENT DOCUMENTS 4,357,734 A * 11/1982 Moore ..... 16/442
5,285,551 A * 2/1994 Weiland et al. ..... 16/442

(Continued)

FOREIGN PATENT DOCUMENTS

JP 58-195479 12/1983
JP 62-076572 5/1987

(Continued)

OTHER PUBLICATIONS

International Search Report for PCT/KR2011/009651, mailed 23 Jul. 2012.

*Primary Examiner* — Roberta Delisle
(74) *Attorney, Agent, or Firm* — Nixon & Vanderhye P.C.

(57) ABSTRACT

The present invention relates to a handle assembly for an airtight container. The handle assembly, intended for an airtight container including a main body on which a plurality of hooks protruding outwardly are disposed on a circumference of the upper end thereof, and a cover on which a plurality of protruding hooks having insertion projections on either end thereof are disposed on the circumference thereof, the cover protruding outwardly so as to correspond to the hooks and opening or closing an upper side of the main body, includes: a pair of side members, each having an insertion hole in which each of the insertion projections of the cover is inserted, and a coupling groove having a predetermined size and being positioned spaced apart from the insertion hole; a central member including fixed parts on either end thereof such that the central member is inserted and fixed to the coupling grooves between the pair of the coupling grooves between the pair of side members; and a separation prevention unit preventing the fixed parts from being separated from the coupling grooves.

7 Claims, 5 Drawing Sheets

(56) References Cited

U.S. PATENT DOCUMENTS

| | | | | |
|---|---|---|---|---|
| 6,668,424 | B1 * | 12/2003 | Allen et al. | 16/444 |
| 6,694,868 | B1 * | 2/2004 | Hung | 99/403 |
| 7,712,590 | B1 * | 5/2010 | Lee | 190/115 |
| 2001/0034923 | A1 * | 11/2001 | Ho | 16/114.1 |
| 2003/0041411 | A1 * | 3/2003 | Chen | 16/110.1 |
| 2004/0182667 | A1 * | 9/2004 | Lin | 190/115 |

FOREIGN PATENT DOCUMENTS

| | | |
|---|---|---|
| KR | 10-2004-0057231 | 7/2004 |
| KR | 20-0365930 | 10/2004 |
| KR | 10-0935641 | 1/2010 |

* cited by examiner

HANDLE ASSEMBLY FOR AN AIRTIGHT CONTAINER

This application is the U.S. national phase of International Application No. PCT/KR2011/009651, filed 15 Dec. 2011, which designated the U.S. and claims priority to KR Application No. 10-2011-0006149, filed 21 Jan. 2011, the entire contents of each of which are hereby incorporated by reference.

TECHNICAL FIELD

The present invention relates to a handle assembly for an airtight container, and more particularly, to a handle assembly for an airtight container, which does not use a shrink-fit when assembling a handle on a cover of the airtight container, thereby preventing damage to the cover or the handle.

BACKGROUND ART

Generally, a food storage container is to store a variety of food. The food storage container includes a main body of which an upper portion is opened so as to receive food, a cover which covers the upper opened portion of the main body, a silicon packing which is disposed at a lower edge portion of the cover so as to air-tightly seal the upper opened portion of the main body, a coupling protrusion which is protruded from both sides of the main body, and a locking handle which is rotatably installed at both sides of the cover and detachably fastened to the coupling protrusion. Herein, the main body and cover are formed into various shapes such as a circle and a square.

In such food storage container, the silicon packing functions to air-tightly seal the upper opened portion of the main body, thereby preventing rotting of food and leaking of food smell.

FIG. 1 is an exploded perspective view of a conventional airtight container. As shown in drawing, the conventional airtight container includes a main body 10 and a cover 20 which covers an opening of the main body 10. And a locking handle 40 is hinged to left and right sides of the cover 20 and a locking protrusion 11 to which the locking handle 40 is fastened is formed at left and right sides of the main body 10, such that the main body 10 and cover (20) are coupled to each other.

And although not shown in drawing, a silicon packing is disposed at a lower edge portion of the cover 20 so that the main body 10 and cover 20 are sealed air-tightly. Herein, the locking handle 40 which is integrally formed by injection molding is formed of a plastic material. A coupling hole 41 is formed at an inside portion of the locking handle 40, and the locking handle 40 is coupled to a coupling protrusion 21 in a shrink-fit.

Therefore, because the locking handle 40 is tightly fitted to the cover 20 in order to assemble the airtight container, a small space is needed between the coupling hole 41 of the locking handle 40 and the coupling protrusion 21 of the cover 20.

Herein, in case that tolerance between the coupling hole 41 of the locking handle 40 and the coupling protrusion 21 of the cover 20 is very small, the locking handle 40 or the coupling hole 41 may be damaged when the locking handle 40 is tightly fitted to the cover 20.

On the contrary, in case that the tolerance therebetween is large, the assembling of the locking handle 40 and cover 20 is facilitated, but the locking handle 40 may be separated from the cover 20 when using the airtight container.

DISCLOSURE

Technical Problem

An object of the present invention is to provide a handle assembly for an airtight container, which does not use a shrink-fit when assembling a handle on a cover of the airtight container, thereby preventing damage to the cover or the handle.

Technical Solution

To achieve the object of the present invention, a first embodiment of the present invention provides a handle assembly for an airtight container which comprises main body that a plurality of hooks protruding outwardly are formed on an upper edge thereof, and a cover that a plurality of protruding hooks having insertion projections on both ends thereof are formed on an edge thereof, the cover protruding outwardly to be corresponding to the hooks of the main body and open or close an upper side of the main body, comprising a pair of side members, each having an insertion hole in which each of the insertion projections of the cover is inserted and a coupling groove which has a predetermined size so as to be spaced apart from the insertion hole; a central member which has fixed parts on both ends thereof such that the central member is inserted and fixed to the coupling grooves between the pair of side members; and a separation preventing means which prevents the fixed parts from being separated from the coupling grooves.

Preferably, each of the fixed parts has a width increased in an extended direction from the both side ends of the side member, and each coupling groove is opened at its upper or lower surface and formed to be corresponding to each fixed part so that the fixed parts are coupled to the coupling grooves in a sliding manner.

More preferably, the fixed parts and coupling grooves are bonded to each other by thermal bonding or ultrasonic bonding.

Preferably, the separation preventing means is a covering member which is bonded to an outside portion of the fixed part inserted into the coupling groove by thermal bonding or ultrasonic bonding.

Further, according to a second embodiment of the present invention, a through-hole is formed upwardly and downwardly in an end of the fixed part, and the side member is formed with a separation preventing pin which is inserted into the through-hole.

Further, a through-hole is formed upwardly and downwardly in an end of the fixed part, and the covering member is formed with a separation preventing pin which is inserted into the through-hole.

Further, according to a third embodiment of the present invention, the fixed parts are extended outwardly from side ends of the central member, and also formed with a pair of hooking pieces of which ends are symmetrically extended outwardly, and the coupling grooves of the side members are respectively formed with a stepped portion in which the hooking pieces are fixed.

Preferably, the side members are respectively formed with a cut-away portion formed by cutting away an upper, lower or outer surface of each side member so that the hooking pieces inserted into the coupling groove are exposed to the outside, and the separation preventing means is a covering member which is bonded to the cut-away portion by thermal bonding or ultrasonic bonding, and the covering member is formed with a separation preventing pin which is protruded so as to be inserted between hooking pieces.

Further, according to a fourth embodiment of the present invention, the side member is formed with a cut-away portion at a front side thereof, and the fixed part is slid in a width direction of the central member and fixed to the side members, and the separation preventing means is a covering member which is coupled to an outside portion of the cut-away portion, in which the fixed part is coupled, by thermal bonding or ultrasonic bonding.

Advantageous Effects

As described above, since the handle assembly of the present invention includes one pair of side members and the central member which is coupled between the side members and the members can be coupled, in turn, to the cover, the handle assembly can be simply coupled to the cover without any damage of the handle or cover.

DESCRIPTION OF DRAWINGS

The above and other objects, features and advantages of the present invention will become apparent from the following description of preferred embodiments given in conjunction with the accompanying drawings, in which.

BEST MODE

Hereinafter, the embodiments of the present invention will be described in detail with reference to accompanying drawings.

First Embodiment

Figure 1:
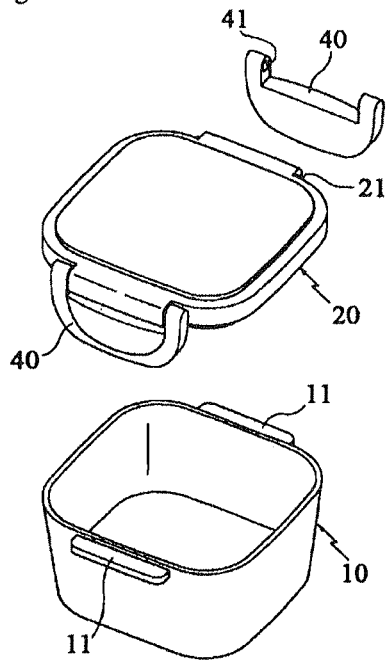
FIG. 1 is an exploded perspective view of a conventional airtight container.
Figure 2:
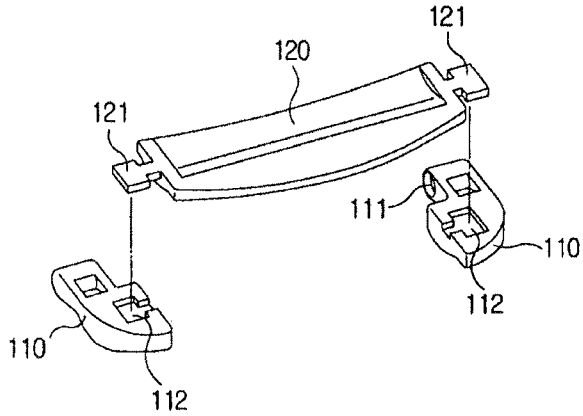
FIG. 2 is an exploded perspective view of a handle assembly for an airtight container according to a first embodiment of the present invention.
Figure 3:
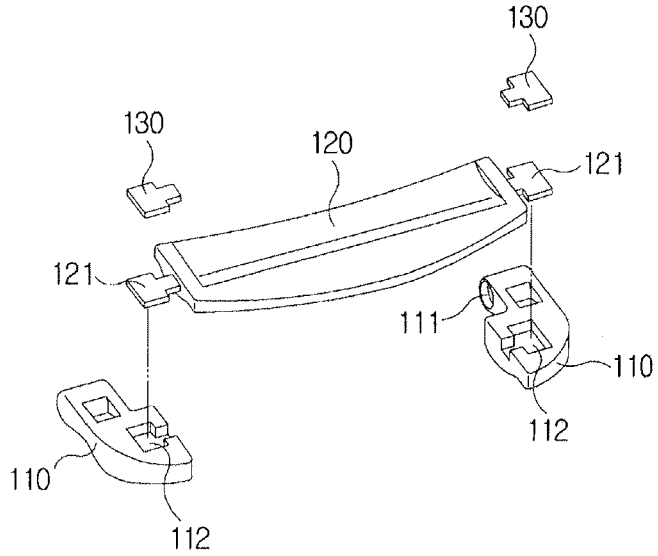
FIG. 3 is an exploded perspective view of the handle assembly according to the first embodiment of the present invention, wherein a covering member is shown.
Figure 4:
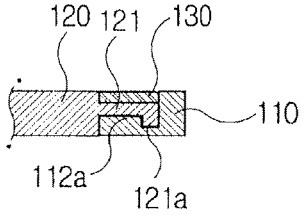
FIG. 4 is a cross-sectional view of FIG. 3.
Figure 5:
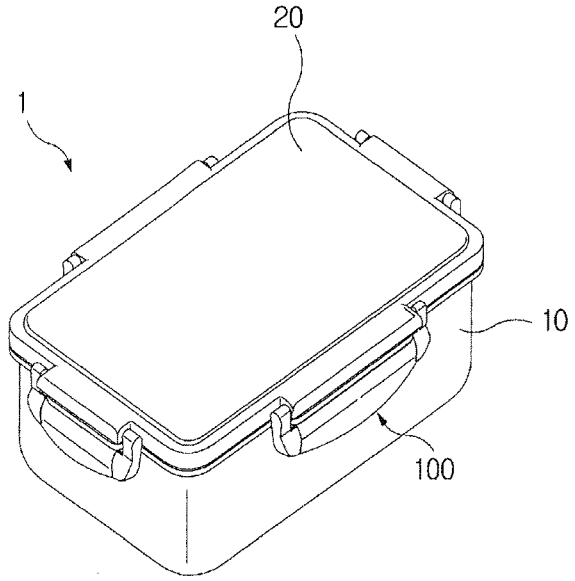
FIG. 5 is a perspective view of an airtight container in which the handle assembly is installed according to the present invention.
Figure 6A:
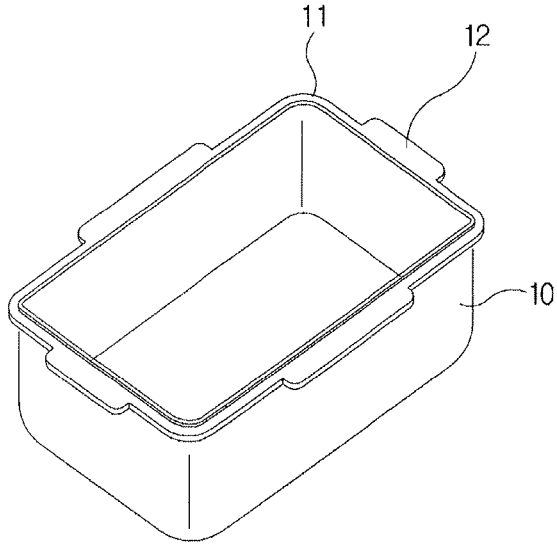
FIG. 6*a* is a perspective view of a main body of the airtight container of FIG. 5.
Figure 6B:
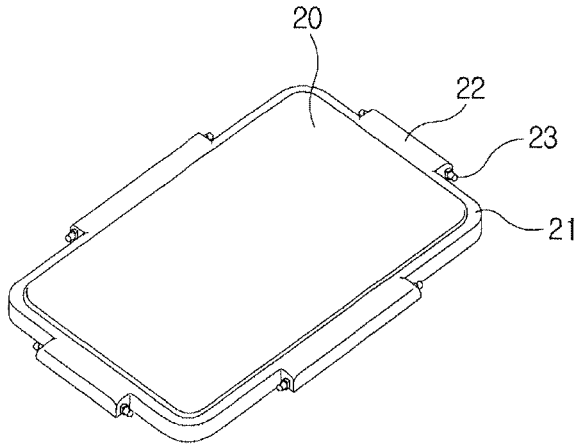
FIG. 6*b* is a perspective view of a cover of the airtight container of FIG. 5.

FIG. 2 is an exploded perspective view of a handle assembly for an airtight container according to a first embodiment of the present invention, FIG. 3 is an exploded perspective view of the handle assembly according to the first embodiment of the present invention, wherein a covering member is shown, FIG. 4 is a cross-sectional view of FIG. 3, FIG. 5 is a perspective view of an airtight container in which the handle assembly is installed according to the present invention, FIG. 6*a* is a perspective view of a main body of the airtight container of FIG. 5, and FIG. 6*b* is a perspective view of a cover of the airtight container of FIG. 5.

As shown in FIGS. 2 to 6*b*, the handle assembly 100 according to the present invention is coupled to an airtight container 1 for storing a variety of food such as side dishes, vegetables, fruits and fishes, which includes a main body 10 and cover 20.

The main body 10 of the airtight container 1 is formed with an internal space for receiving food. An upper portion of the main body 10 is opened, and a plurality of hooks 12 protruding outwardly are formed on an upper edge 11 of the main body 10. The cover 20 of the airtight container 1 functions to open and close the opened upper portion of the main body 10. A plurality of protruding hooks 22 is formed on an edge 21 of the cover 20 so as to be corresponding to the plurality of hooks 12 of the main body 10. Insertion projections 23 which are inserted into an insertion hole 111 of the handle assembly 100, as described later, are formed at both ends of the protruding hooks 22.

The handle assembly (100) includes a pair of side members 110, a central member 120 and a separation preventing means.

The pair of side members 110 are respectively formed with the insertion hole 111 in which the insertion projection 23 of the cover 20 is inserted and also rotatably coupled to the protruding hooks 22 of the cover 20. Further, the pair of side members 110 are respectively formed with a coupling groove 112 which has a predetermined size and is located to be spaced apart from the insertion hole 111 of the side member 110.

The central member 120 is provided with fixed parts 121 which are protruded from both side ends thereof. The fixed parts 121 are respectively inserted into the coupling groove 112 of each side member 110 so that the central member 120 is fixed between the pair of side members.

The separation preventing means is to prevent separation of the fixed parts 121 inserted and fixed to the coupling groove 112. The separation preventing means may include at least one of a covering member 130 to be described later, and a separation preventing pin 131 formed at the covering member 130.

According to the first embodiment of the present invention, a portion of each fixed part 121 which is away from the both side ends of the side member 110 is formed to be wider than another portion thereof which is adjacent to the both side ends of the side member 110. That is, a width of each fixed part 121 is increased in an extended direction from the both side ends of the side member 110, and as shown in FIG. 2, the fixed portion 121 may be formed into a stepped shape that the width of the portion which is adjacent to the both side ends of the side member 110 is sharply differed from that of the portion which is away from the side end of each side member 110, or another shape that the width is gradually increased from the both side ends of the side member 110 toward the extended direction.

An upper surface of the coupling groove 112 is opened, and the coupling groove 112 is formed to be corresponding to the fixed part 121 so that the fixed part 121 can be slid through the opened upper surface of the coupling groove 112 and inserted into the coupling groove 112.

Of course, a lower surface of the coupling groove 112 may be opened and thus the fixed part 121 may be slid through the opened lower surface of the coupling groove 112 and inserted into the coupling groove 112.

Due to the formation of the fixed part 121 and coupling groove 112, the side members 110 and central member 120 are prevented from being separated laterally, while the fixed part 121 is fixed to the coupling groove 112.

Further, since the fixed part 121 and coupling groove 112 are coupled in a sliding manner, it is possible to efficiently prevent the damage of the coupling parts which may occur when the conventional coupling protrusion and coupling hole are coupled in the shrink fit.

Preferably, the fixed part 121 and coupling groove 112 may be bonded to each other by thermal bonding or ultrasonic bonding.

And as shown in FIG. 3, the above-mentioned separation preventing means is the covering member 130 which is inserted into the coupling groove 112 extended above the fixed part 121, while the fixed part 121 is inserted into the coupling groove 112. The covering member 130 may be also bonded to the coupling groove 112 and fixed part 121 by thermal bonding or ultrasonic bonding.

Meanwhile, as shown in FIG. 4, the fixed part 121 is formed with a bent portion 121*a* which is formed by bending an end of fixed part 121 and the coupling groove 112 is also formed with a stepped portion 112*a* corresponding to the bent portion 121*a*, and thus the fixed part 121 is prevented from being separated laterally. In this case, it is not necessary for the width of the fixed part 121 to be increased in the extended direction from the both side ends of the side member 110.

As described above, in the handle assembly according to the first embodiment of the present invention, since the fixed part 121 and coupling groove 112 are formed to be corresponding to each other and also coupled to each other in the sliding manner, it can be assembled without any damage.

Meanwhile, in drawings, it is shown that the handle assembly 100 is formed with the insertion hole 111 and the main body 10 of the airtight container is formed with the insertion projection 23. However, the handle assembly 100 may be formed with the insertion projection and the main body 10 of the airtight container may be formed with the insertion hole. Further, the fixed part may be formed at the side member and the coupling groove may be formed at the central member.

Second Embodiment

Figure 7:
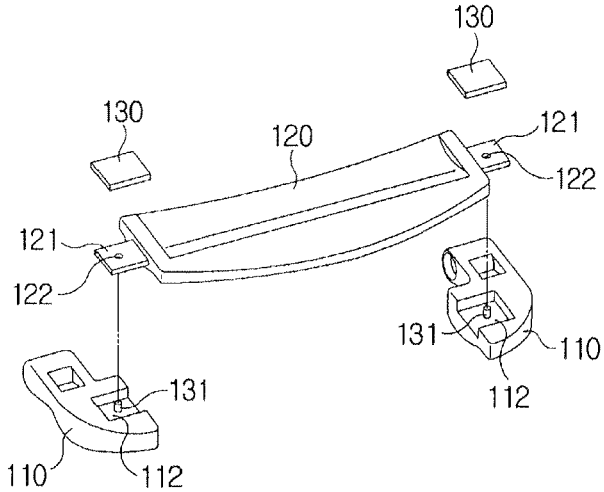
FIGS. 7 and 8 are exploded perspective views of a handle assembly for an airtight container according to a second embodiment of the present invention.
Figure 8:
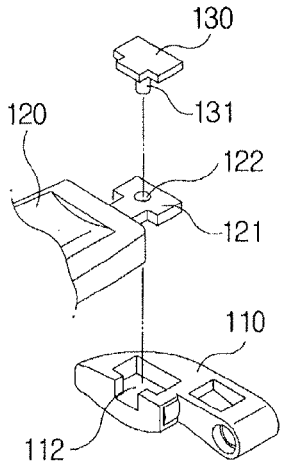

FIGS. 7 and 8 are exploded perspective views of a handle assembly for an airtight container according to a second embodiment of the present invention. As shown in FIG. 7, the handle assembly 100 according to the second embodiment of the present invention is different from that of the first embodiment in that a through-hole 122 is formed upwardly and downwardly in an end of the fixed part 121.

Detailedly, the handle assembly according to the second embodiment of the present invention is provided with the separation preventing pin 131 which is inserted into the through-hole 122 formed in the end of the fixed part 121. As shown in FIG. 7, the separation preventing pin 131 is protruded upwardly from the coupling groove 112 of the side member 110 and inserted into the through-hole 122.

Further, as shown in FIG. 8, the separation preventing pin 131 may be protruded downwardly from a lower surface of the covering member 130 and inserted into the through-hole 122.

In case that the separation preventing pin 131 is formed at the coupling groove 112 of the side member 110, as shown in FIG. 7, it is possible to prevent the separation of the central member 120 and side member 110 without bonding of the covering member 130 in the coupling groove 112.

And in case that the separation preventing pin 131 is formed to be protruded from the lower surface of the covering member 130, as shown in FIG. 8, the covering member 130 has to be bonded to the coupling groove 112 by the thermal bonding or ultrasonic bonding, or a stepped portion by which the covering member 130 is fixed to the coupling groove 112 has to be provided in order to prevent the central member 120 and side member 110 from being separated from each other.

According to the second embodiment, as described above, since the through-hole 122 is formed in the fixed part 121 and the separation preventing pin 131 is inserted into the through-hole 122, it is possible to couple the central member 120 and side member 110 without any damage.

Third Embodiment

Figure 9:
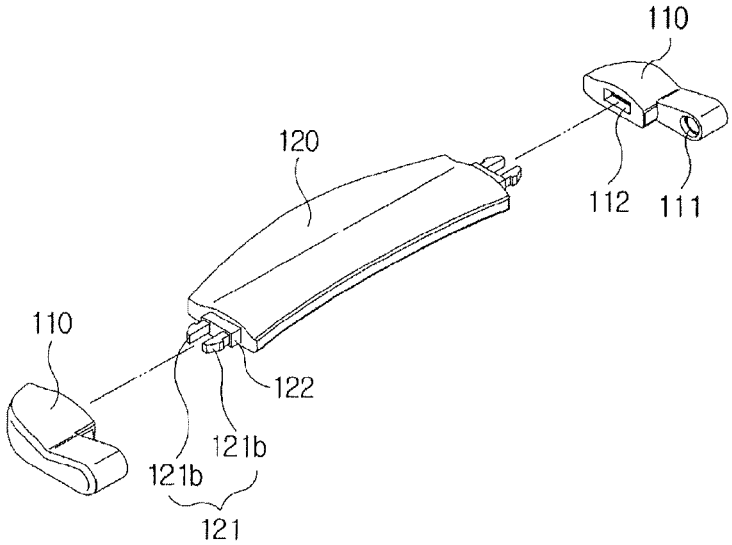
FIG. 9 is an exploded perspective view of a handle assembly for an airtight container according to a third embodiment of the present invention.
Figure 10:
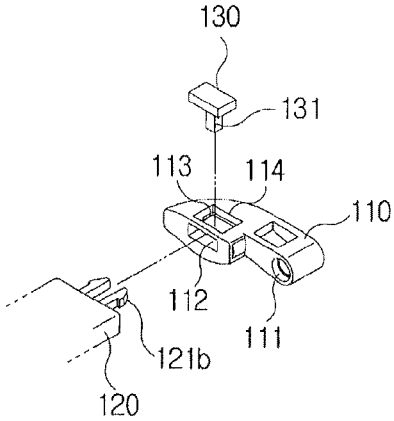
FIGS. 10 to 12 are exploded perspective view of a separation preventing means of the handle assembly according to the third embodiment of the present invention.
Figure 11:
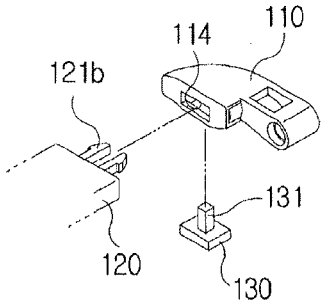
Figure 12:
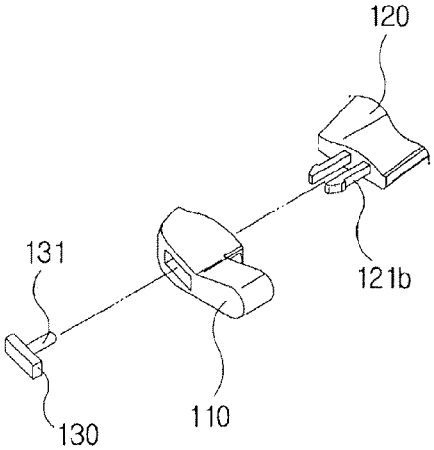

FIG. 9 is an exploded perspective view of a handle assembly for an airtight container according to a third embodiment of the present invention, and FIGS. 10 to 12 are exploded perspective view of a separation preventing means of the handle assembly according to the third embodiment of the present invention.

As shown in FIG. 9, in the handle assembly according to the third embodiment of the present invention, the fixed part 121 of the central member 120 is formed with a pair of hooking pieces 121*b*, and the coupling groove 112 of the side member is formed with a stepped portion 113 in which the hooking pieces are fixed.

Detailedly, the pair of hooking pieces 121*b* is extended outwardly from each side end of the central member 120, and ends of the hooking pieces 121*b* are laterally extended in the opposite direction and formed into a hook shape.

As described above, since the fixed part 121 is comprised of the pair of hooking pieces 121*b*, the fixed part 121 can be inserted and fixed to the coupling groove 112 of the side member 110 by its own elastic force.

Preferably, the handle assembly according to the third embodiment of the present invention includes a cut-away portion 114 through which the hooking pieces 121*b* inserted into the coupling groove 112 are exposed to the outside, a covering member 130 which is coupled to the cut-away portion 114, and a separation preventing pin 131 which is inserted between the pair of hooking pieces 121*b*.

More detailedly, as shown in FIGS. 10 to 12, an upper, lower or outer surface of the side member 110 is cut away so as to be expose the fixed part 121 inserted into the coupling groove 112 to the outside, thereby forming the cut-away portion 114. And the covering member 130 can be bonded to the cut-away portion 114 of the side member 110 by the thermal bonding or ultrasonic bonding.

Herein, the separation preventing pin 131 is formed to be protruded from a lower, upper or side surface of the covering member 130 according to a position of the cut-away portion 114, and then inserted between the hooking pieces 121*b*.

As described above, since the separation preventing pin 131 is inserted between the hooking pieces 121*b*, the hooking pieces 121*b* are not gathered together, but a constant space is maintained therebetween. Therefore, the ends of the hooking pieces 121*b* are stably fixed to the stepped portion 113 of the coupling groove 112, and thus it is certainly prevented that the central member 120 and side members 110 are separated from each other.

Fourth Embodiment

Figure 13:
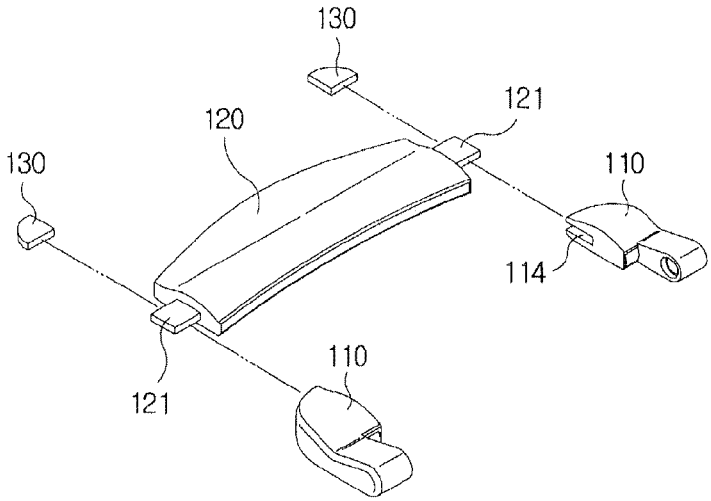
FIG. 13 is an exploded perspective view of a handle assembly for an airtight container according to a fourth embodiment of the present invention.

FIG. 13 is an exploded perspective view of a handle assembly for an airtight container according to a fourth embodiment of the present invention. As shown in FIG. 13, in the handle assembly according to the fourth embodiment of the present invention, the central member 120 is configured to be slid in the width direction vertical to the length direction and then coupled to the side members 110.

To this end, the side member 110 is formed with a cut-away portion 114 in the width direction of the central member 120, and the fixed part 121 is slid in the width direction of the central member 120 and fixed to the side members 110. Herein, the cut-away portion 114 functions to guide the sliding of the fixed part 121.

Further, the covering member 130 as the separation preventing means is coupled to an outside portion of the cut-away portion 114 in which the fixed part 121 is coupled. Then the covering member 130 is boned to the cut-away portion 114 by the thermal bonding or ultrasonic bonding.

According to the fourth embodiment of the present invention, as described above, since the central member 120 is coupled to the side members in the width direction thereof, it is possible to increase utilization of space during an automatic assembling process of the handle assembly.

Figure 14:
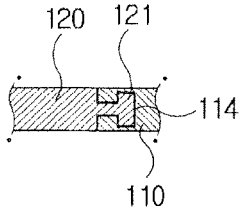
FIG. 14 is a view showing other type of the handle assembly according to the fourth embodiment of the present invention.

Meanwhile, FIG. 14 is a view showing other type of the handle assembly according to the fourth embodiment of the present invention. As shown in FIG. 14, in order to prevent the separation of the central member 120 in the length direction, the fixed part 121 is formed to be protruded upwardly and downwardly, and the cut-away portion 114 of the side member 110 is formed to be corresponding to the protruded shape of the fixed part 121 and thus engaged with the fixed part 121. Therefore, it is prevented that the central member 120 and side member 110 are separated in the length direction. While the present invention has been described with respect to the specific embodiments, it will be apparent to those skilled in the art that various changes and modifications may be made without departing from the spirit and scope of the invention as defined in the following claims.

Industrial Applicability

According to the present invention, since the handle assembly of the present invention includes one pair of side members and the central member which is coupled between the side members and the members can be coupled, in turn, to the cover, the handle assembly can be simply coupled to the cover without any damage of the handle or cover.

The invention claimed is:

1. A handle assembly for an airtight container which comprises main body that a plurality of hooks protruding outwardly are formed on an upper edge thereof, and a cover that a plurality of protruding hooks having insertion projections on both ends thereof are formed on an edge thereof, the cover protruding outwardly to be corresponding to the hooks of the main body and open or close an upper side of the main body, comprising:

a pair of side members, each having an insertion hole in which each of the insertion projections of the cover is inserted and a coupling groove which has a predetermined size so as to be spaced apart from the insertion hole;

a central member which has fixed parts on both ends thereof such that the central member is inserted and fixed to the coupling grooves between the pair of side members; and a separation preventing means which prevents the fixed parts from being separated from the coupling grooves, wherein each of the fixed part has a width increased in an extended direction from the both side ends of the side member, and each coupling groove is opened at its upper or lower surface and formed to be corresponding to each fixed part so that the fixed parts are coupled to the coupling grooves in a sliding manner.

2. The handle assembly according to claim 1, wherein the fixed parts and coupling grooves are bonded to each other by thermal bonding or ultrasonic bonding.

3. A handle assembly for an airtight container which comprises main body that a plurality of hooks protruding outwardly are formed on an upper edge thereof, and a cover that a plurality of protruding hooks having insertion projections on both ends thereof are formed on an edge thereof, the cover protruding outwardly to be corresponding to the hooks of the main body and open or close an upper side of the main body, comprising:

a pair of side members, each having an insertion hole in which each of the insertion projections of the cover is inserted and a coupling groove which has a predetermined size so as to be spaced apart from the insertion hole;

a central member which has fixed parts on both ends thereof such that the central member is inserted and fixed to the coupling grooves between the pair of side members; and a separation preventing means which prevents the fixed parts from being separated from the coupling grooves, wherein the separation preventing means is a covering member which is bonded to an outside portion of the fixed part by thermal bonding or ultrasonic bonding.

4. The handle assembly according to claim 3, wherein a through-hole is formed upwardly and downwardly in an end of the fixed part, and the side member is formed with a separation preventing pin which is inserted into the through-hole.

5. The handle assembly according to claim 3, wherein a through-hole is formed upwardly and downwardly in an end of the fixed part, and the covering member is formed with a separation preventing pin which is inserted into the through-hole.

6. A handle assembly for an airtight container which comprises main body that a plurality of hooks protruding outwardly are formed on an upper edge thereof, and a cover that a plurality of protruding hooks having insertion projections on both ends thereof are formed on an edge thereof, the cover protruding outwardly to be corresponding to the hooks of the main body and open or close an upper side of the main body, comprising:

a pair of side members, each having an insertion hole in which each of the insertion projections of the cover is inserted and a coupling groove which has a predetermined size so as to be spaced apart from the insertion hole;

a central member which has fixed parts on both ends thereof such that the central member is inserted and fixed to the coupling grooves between the pair of side members; and a separation preventing means which prevents the fixed parts from being separated from the coupling grooves, wherein the fixed parts are extended outwardly from side ends of the central member, and also formed with a pair of hooking pieces of which ends are symmetrically extended outwardly, and the coupling grooves of the side members are respectively formed with a stepped portion in which the hooking pieces are fixed, and the side members are respectively formed with a cut-away portion formed by cutting away an upper, lower or outer surface of each side member so that the hooking pieces inserted into the coupling groove are exposed to the outside, and the separation preventing means is a covering member which is bonded to the cut-away portion by thermal bonding or ultrasonic bonding, and the covering member is formed with a separation preventing pin which is protruded so as to be inserted between hooking pieces.

7. A handle assembly for an airtight container which comprises main body that a plurality of hooks protruding outwardly are formed on an upper edge thereof, and a cover that a plurality of protruding hooks having insertion projections on both ends thereof are formed on an edge thereof, the cover protruding outwardly to be corresponding to the hooks of the main body and open or close an upper side of the main body, comprising:

a pair of side members, each having an insertion hole in which each of the insertion projections of the cover is inserted and a coupling groove which has a predetermined size so as to be spaced apart from the insertion hole;

a central member which has fixed parts on both ends thereof such that the central member is inserted and fixed to the coupling grooves between the pair of side members; and a separation preventing means which prevents the fixed parts from being separated from the coupling grooves, wherein the side member is formed with a cut-away portion at a front side thereof, and the fixed part is slid in a width direction of the central member and fixed to the side members, and the separation preventing means is a covering member which is coupled to an outside portion of the cut-away portion, in which the fixed part is coupled, by thermal bonding or ultrasonic bonding.

* * * * *